US012807370B2

(12) United States Patent
Zeinner

(10) Patent No.: US 12,807,370 B2
(45) Date of Patent: Nov. 24, 2026

(54) STACKABLE TRAY

(71) Applicant: LEM Products Holdings, LLC, West Chester, OH (US)

(72) Inventor: Tyandra Zeinner, Cincinnati, OH (US)

(73) Assignee: LEM Products Holdings, LLC, West Chester, OH (US)

( * ) Notice: Subject to any disclaimer, the term of this patent is extended or adjusted under 35 U.S.C. 154(b) by 72 days.

(21) Appl. No.: 17/831,982

(22) Filed: Jun. 3, 2022

(65) Prior Publication Data

US 2022/0411129 A1 Dec. 29, 2022

Related U.S. Application Data

(60) Provisional application No. 63/215,663, filed on Jun. 28, 2021.

(51) Int. Cl.
*B65D 21/02* (2006.01)
*B65D 1/36* (2006.01)

(52) U.S. Cl.
CPC ..... *B65D 21/0234* (2013.01); *B65D 1/36* (2013.01)

(58) Field of Classification Search
CPC ..... B65D 21/0234; B65D 1/36; B65D 21/045–46
USPC ..... 206/509
See application file for complete search history.

(56) References Cited

U.S. PATENT DOCUMENTS

| | | | | |
|---|---|---|---|---|
| 3,191,791 | A | 6/1965 | Jackson | |
| 5,230,601 | A | 7/1993 | Apps et al. | |
| 5,377,862 | A | 1/1995 | Oakes et al. | |
| 5,634,559 | A | 6/1997 | Foos et al. | |
| 7,721,891 | B2 | 5/2010 | Dubois | |
| 8,333,275 | B2 * | 12/2012 | McFarlane | B65D 1/243 220/519 |
| 9,101,212 | B2 | 8/2015 | De Roeck | |
| 10,227,157 | B2 | 3/2019 | Kuruvilla et al. | |
| 10,583,961 | B2 | 3/2020 | Gosen et al. | |
| 10,654,613 | B2 | 5/2020 | Liu | |
| 10,961,044 | B2 * | 3/2021 | Cardoso | B65D 1/36 |
| 11,459,141 | B1 * | 10/2022 | Kaldahl | F42B 39/26 |
| 2006/0065702 | A1 | 3/2006 | Beese | |
| 2006/0237341 | A1 | 10/2006 | McDade | |
| 2007/0246392 | A1 | 10/2007 | Stahl | |
| 2009/0108002 | A1 | 4/2009 | Delbrouck et al. | |

(Continued)

FOREIGN PATENT DOCUMENTS

WO 9212055 A1 7/1992

*Primary Examiner* — Robert J Hicks
*Assistant Examiner* — Sanjidul Islam
(74) *Attorney, Agent, or Firm* — Taft Stettinius & Hollister LLP

(57) ABSTRACT

An exemplary system is provided for holding canning jars of varying sizes, and generally includes a first tray and a second tray. The first tray includes a first plurality of wells, including a first tray first well. The first tray first well includes a first engagement feature on an exterior surface thereof, and the first engagement feature has a first geometry. The second tray includes a second plurality of wells, including a second tray first well. The second tray first well includes a second engagement feature on an exterior surface thereof, and the second engagement feature has a second geometry configured to mate with the first geometry. Each well of the first plurality of wells has a greater diameter than each well of the second plurality of wells.

18 Claims, 10 Drawing Sheets

(56) References Cited

U.S. PATENT DOCUMENTS

| | | | | |
|---|---|---|---|---|
| 2010/0147642 | A1* | 6/2010 | Andochick | A45C 5/14 206/315.3 |
| 2011/0180446 | A1* | 7/2011 | Kidd | B65D 85/34 206/509 |
| 2013/0047558 | A1 | 2/2013 | Hogan | |

* cited by examiner

STACKABLE TRAY

CROSS-REFERENCE TO RELATED APPLICATIONS

The present application claims the benefit of US Provisional Patent Application No. 63/215,663, filed Jun. 28, 2021, the contents of which are incorporated by reference in their entirety.

TECHNICAL FIELD

The present disclosure generally relates to stackable trays and crates, and more particularly but not exclusively relates to stackable trays and crates configured to hold jarred goods.

BACKGROUND

Jars used for canning purposes are often provided in various standard sizes, including pint-sized and quart-sized. Such canning jars are often stored in trays or crates. Some existing crates accommodate pint-sized jars and are stackable on themselves, while other existing crates accommodate quart-sized jars and are stackable on themselves. However, due to the difference in sizes of the pint-sized jars and the quart-sized jars, existing crates for pint-sized jars cannot be stacked with crates for quart-sized jars. For these reasons among others, there remains a need for further improvements in this technological field.

SUMMARY

An exemplary system is provided for holding canning jars of varying sizes, and generally includes a first tray and a second tray. The first tray includes a first plurality of wells, including a first tray first well. The first tray first well includes a first engagement feature on an exterior surface thereof, and the first engagement feature has a first geometry. The second tray includes a second plurality of wells, including a second tray first well. The second tray first well includes a second engagement feature on an exterior surface thereof, and the second engagement feature has a second geometry configured to mate with the first geometry. Each well of the first plurality of wells has a greater diameter than each well of the second plurality of wells. Further embodiments, forms, features, and aspects of the present application shall become apparent from the description and figures provided herewith.

DETAILED DESCRIPTION OF ILLUSTRATIVE EMBODIMENTS

Figure 1:
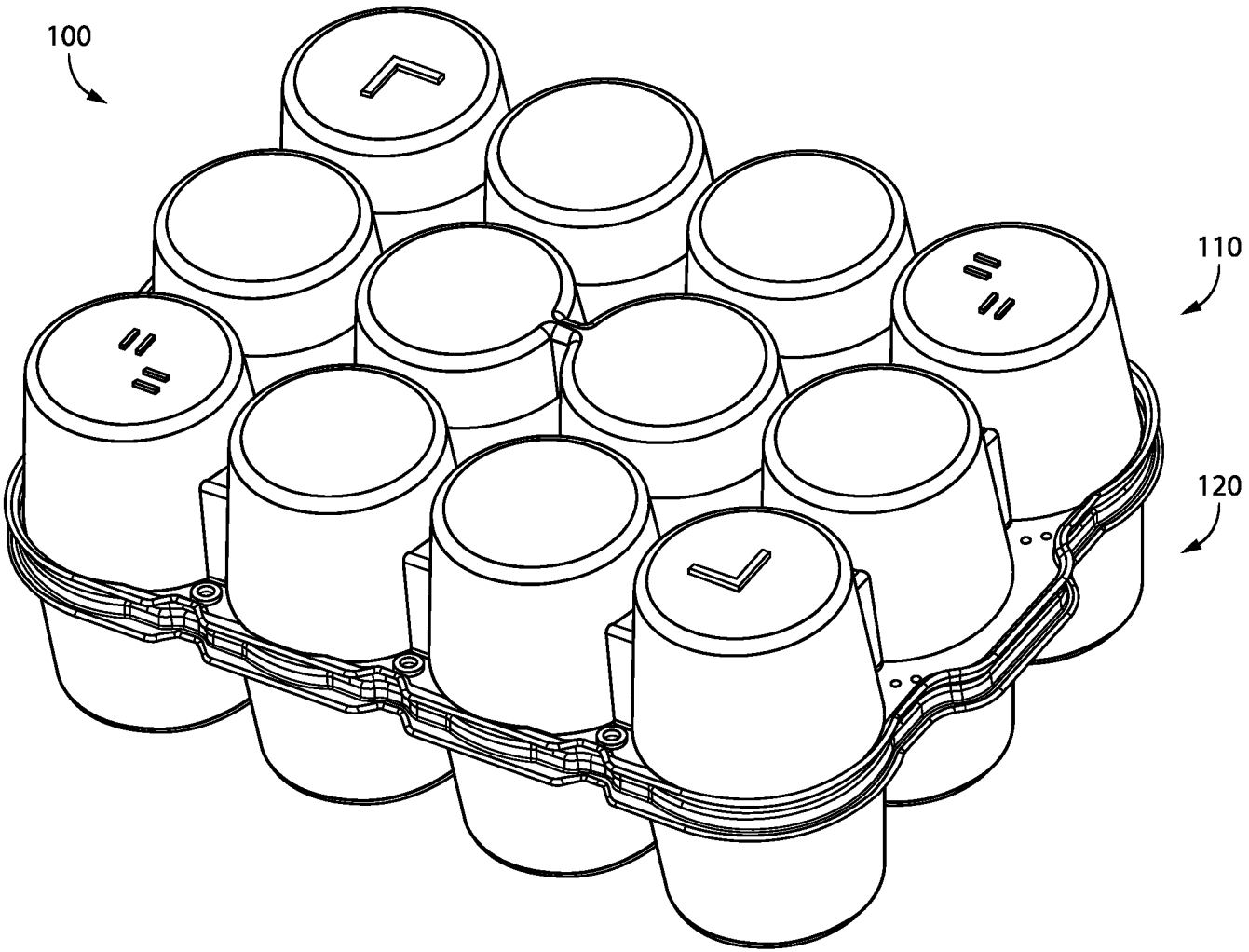
FIG. 1 is a perspective view of an assembled first crate according to certain embodiments.

Although the concepts of the present disclosure are susceptible to various modifications and alternative forms, specific embodiments have been shown by way of example in the drawings and will be described herein in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. It should further be appreciated that although reference to a "preferred" component or feature may indicate the desirability of a particular component or feature with respect to an embodiment, the disclosure is not so limiting with respect to other embodiments, which may omit such a component or feature. Further, when a particular feature, structure, or characteristic is described in connection with an embodiment, it is submitted that it is within the knowledge of one skilled in the art to implement such feature, structure, or characteristic in connection with other embodiments whether or not explicitly described.

Additionally, it should be appreciated that items included in a list in the form of "at least one of A, B, and C" can mean (A); (B); (C); (A and B); (B and C); (A and C); or (A, B, and C). Similarly, items listed in the form of "at least one of A, B, or C" can mean (A); (B); (C); (A and B); (B and C); (A and C); or (A, B, and C). Items listed in the form of "A, B, and/or C" can also mean (A); (B); (C); (A and B); (B and C); (A and C); or (A, B, and C). Further, with respect to the claims, the use of words and phrases such as "a," "an," "at least one," and/or "at least one portion" should not be interpreted so as to be limiting to only one such element unless specifically stated to the contrary, and the use of phrases such as "at least a portion" and/or "a portion" should be interpreted as encompassing both embodiments including only a portion of such element and embodiments including the entirety of such element unless specifically stated to the contrary.

In the drawings, some structural or method features may be shown in certain specific arrangements and/or orderings. However, it should be appreciated that such specific arrangements and/or orderings may not necessarily be required. Rather, in some embodiments, such features may be arranged in a different manner and/or order than shown in the illustrative figures unless indicated to the contrary. Additionally, the inclusion of a structural or method feature in a particular figure is not meant to imply that such feature is required in all embodiments and, in some embodiments, may be omitted or may be combined with other features.

With reference to FIG. 1, illustrated therein is a crate 100 according to certain embodiments. While other storage items are contemplated, the illustrated crate 100 is configured to hold canning jars of a particular size (e.g., pint-sized or quart-sized). In the illustrated form, the crate 100 is configured to hold standard quart-sized canning jars. As described herein, other embodiments of the present application are configured to hold standard pint-sized canning jars. The crate 100 includes an upper tray 110 and a lower tray 120. In the illustrated form, the upper tray 110 and the lower tray 120 are substantially identical, which may aid in reducing inventory requirements and/or facilitate production. In other embodiments, the upper tray 110 and the lower tray 120 may not necessarily be identical.

Figure 2:
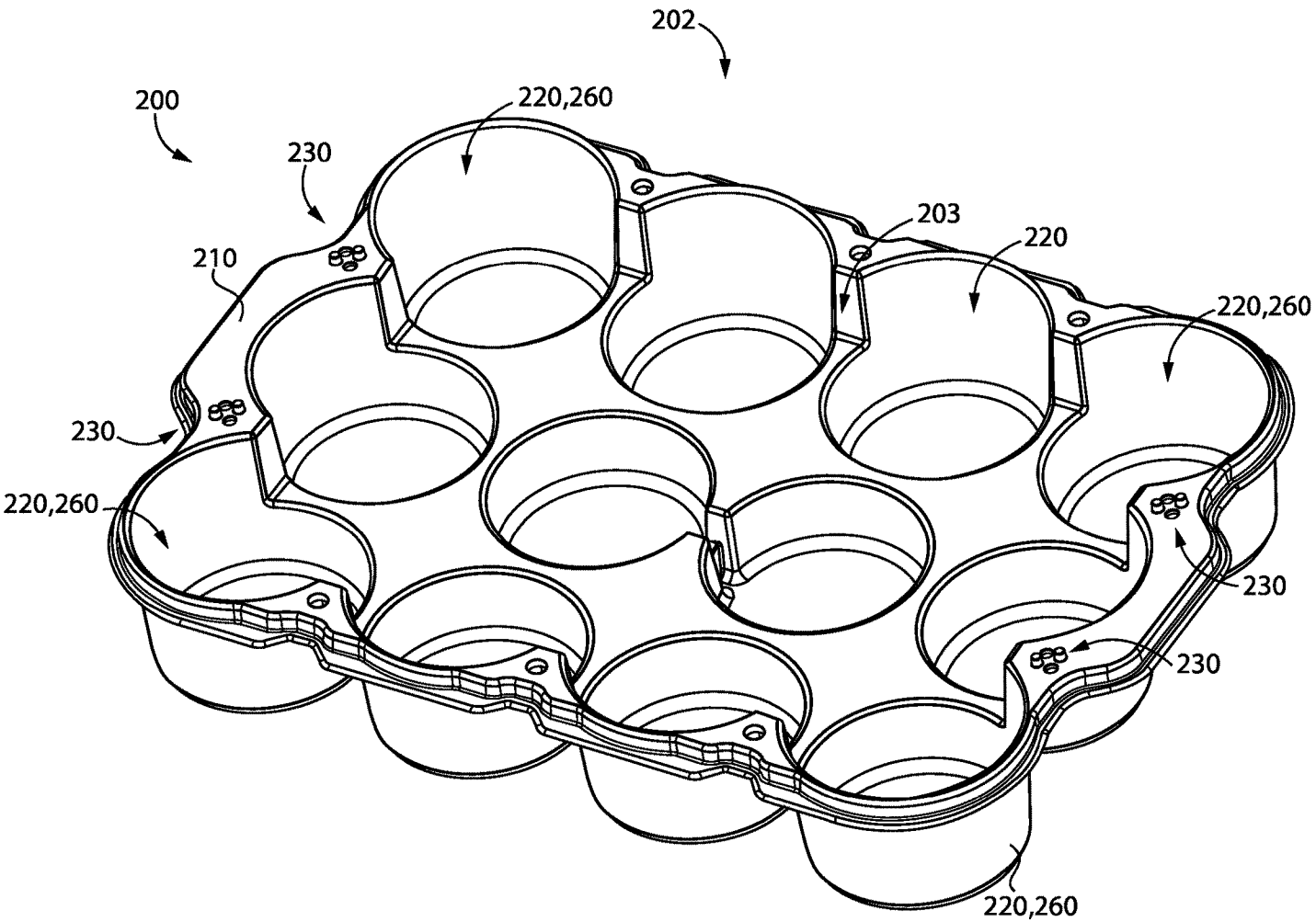
FIG. 2 is a first perspective view of a first tray that may be utilized to build the first crate.
Figure 3:
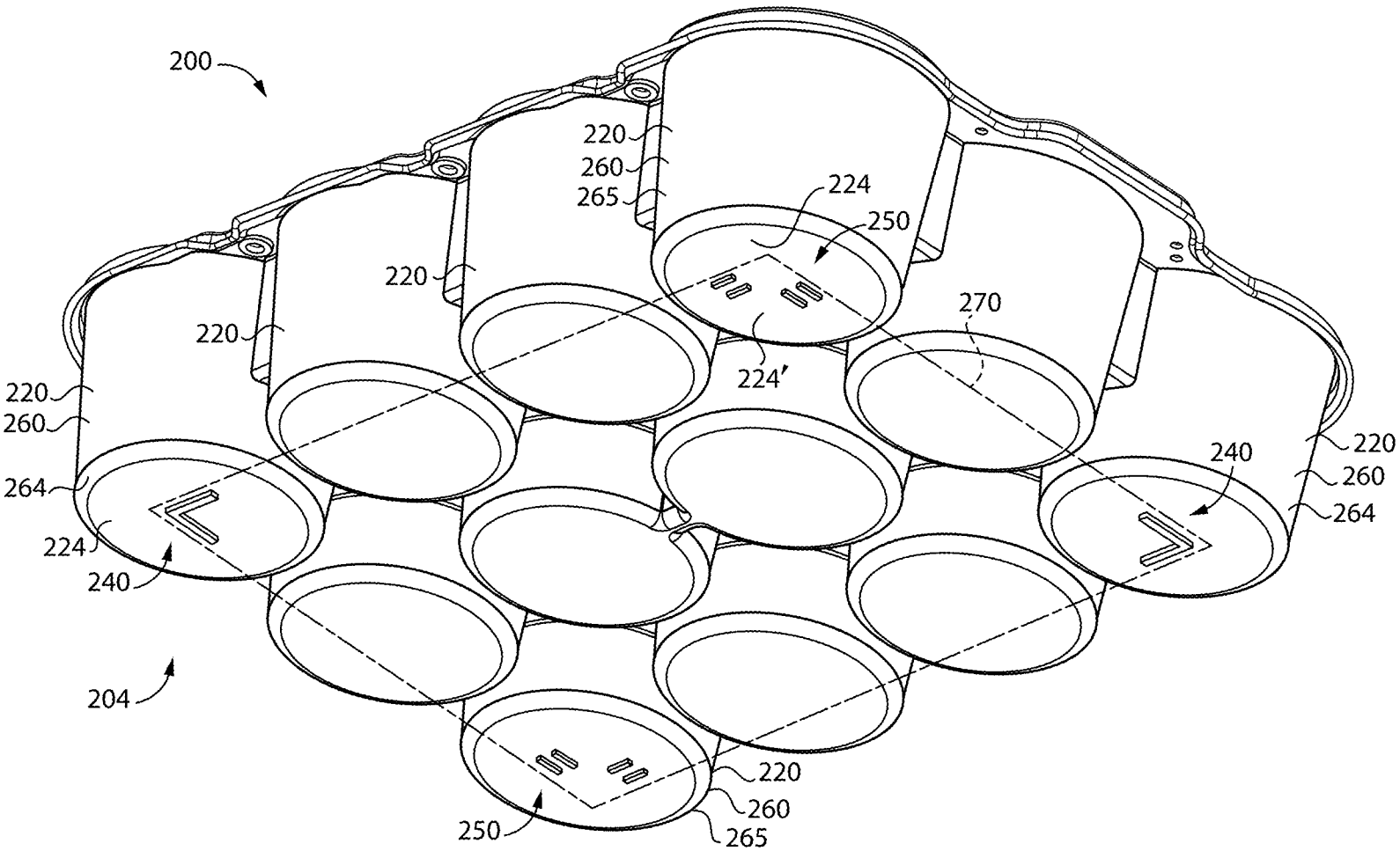
FIG. 3 is a second perspective view of the first tray.

With additional reference to FIGS. 2 and 3, illustrated therein is a tray 200 according to certain embodiments. The tray 200 may, for example, be utilized as the upper tray 110 and/or the lower tray 120 of the crate 100. For example, a first of the tray 200 may be utilized as the upper tray 110 and a second of the tray 200 may be utilized as the lower tray 120. The tray 200 generally includes a female first side 202 (FIG. 2) and an opposite male second side 204 (FIG. 3). When the tray 200 is utilized as an upper tray (e.g., the upper tray 110), the first side 202 is a bottom or lower side, and the second side 204 is a top or upper side. Conversely, when the tray 200 is utilized as a lower tray (e.g., the lower tray 120), the first side 202 is a top or upper side, and the second side 204 is a bottom or lower side.

The tray 200 generally includes a base portion 210 defining an outer perimeter of the tray 200, and a plurality of wells 220 extending from the base portion 210 such that the first side 202 defines a cavity 203. In the illustrated form, the first side 202 includes one or more snap mechanisms 230 formed in the base portion 210, and the second side 204 includes one or more first engagement features 240 and one or more second engagement features 250. As described herein, the engagement features 240, 250 occupy and define an engagement area 270 on the second side 204 of the tray 200.

Each well 220 is sized and shaped to receive a particular size of jar, and in the illustrated form is sized and shaped to receive a standard quart-sized jar. Each well 220 has an interior side 222 corresponding to the first side 202 of the tray and an exterior side 224 corresponding to the exterior side 204 of the tray 200. In the illustrated form, the tray 200 includes twelve wells 220 arranged in three rows and four columns. It is also contemplated that more or fewer wells 220 may be utilized, and that more or fewer rows and/or columns may be utilized. With the wells 220 arranged in a generally rectangular array, the tray 200 includes four "corner" wells 260. As described herein, the four corner wells 260 include a pair of first corner wells 264 and a pair of second corner wells 265. Each of the first corner wells 264 includes a corresponding first engagement feature 240, and each of the second corner wells 265 includes a corresponding second engagement feature 250.

Figure 4:
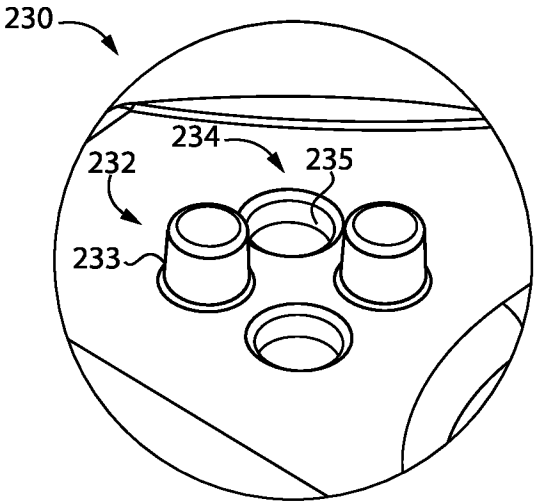
FIG. 4 is a perspective view of a snap mechanism according to certain embodiments.

With additional reference to FIG. 4, each of the illustrated snap mechanisms 230 includes at least one first snap feature 232 having a first geometry and at least one second snap feature 234 having a second geometry configured to mate with the first geometry. In the illustrated form, each first snap feature 232 is provided as a male protrusion 233, and each second snap feature 234 is provided as a female recess 235 sized and shaped to receive the protrusion 233. The snap features 232, 234 are arranged such that each snap mechanism 230 is operable to engage another instance of itself. Thus, when a first of the tray 200 is utilized as the upper tray 110 and a second of the tray 200 is utilized as the lower tray 120, the snap mechanisms 230 of the upper tray 110 will engage the snap mechanisms 230 of the lower tray 120 to discourage separation of the trays 110, 120.

Figure 5:
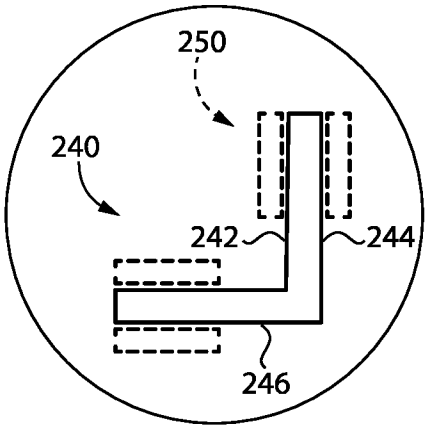
FIG. 5 is a plan view of a first engagement feature according to certain embodiments.

With additional reference to FIG. 5, the first engagement feature 240 has a first geometry. In the illustrated form, the geometry of the first engagement feature 240 includes an L-shaped protrusion 242 including a first leg 244 and a second leg 246 extending perpendicular to the first leg 244. While the illustrated legs 244, 246 are connected to one another, it is also contemplated that the legs 244, 246 may not necessarily be connected. Furthermore, while one example geometry has been illustrated for the first engagement feature, it should be appreciated that other geometries may be utilized.

Figure 6:
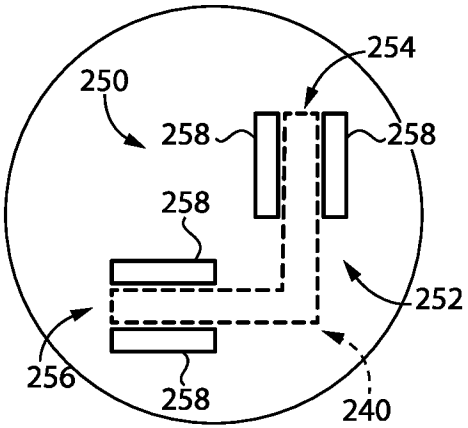
FIG. 6 is a plan view of a second engagement feature according to certain embodiments.

With additional reference to FIG. 6, the second engagement feature 250 has a second geometry sized and shaped to mate with the geometry of the first engagement feature 240. In the illustrated form, the geometry of the second engagement feature 250 is a generally L-shaped female recess 252 configured for engagement with the L-shaped protrusion 242. The L-shaped recess 252 includes a first channel 254 configured to receive the first leg 244 and a second channel 256 configured to receive the second leg 246. In the illustrated form, each channel 254, 256 is defined by a corresponding pair of ridges 258 that protrude from the exterior surface 224 of the corresponding well 220 such that the flat exterior surface 224 defines a bottom of each channel 254, 256. Stated another way, each instance of the illustrated engagement area 270 projects from a flat area 224' of the corresponding exterior surface 224 such that the flat areas 224' define bottoms of the corresponding recesses 252. It is also contemplated that the channels 254 may be recessed into the exterior surface 224 of the well 220. Furthermore, while the channels 254, 256 of the illustrated second engagement feature 250 do not connect, it is also contemplated that the channels 254, 256 may connect in certain embodiments.

Figure 7:
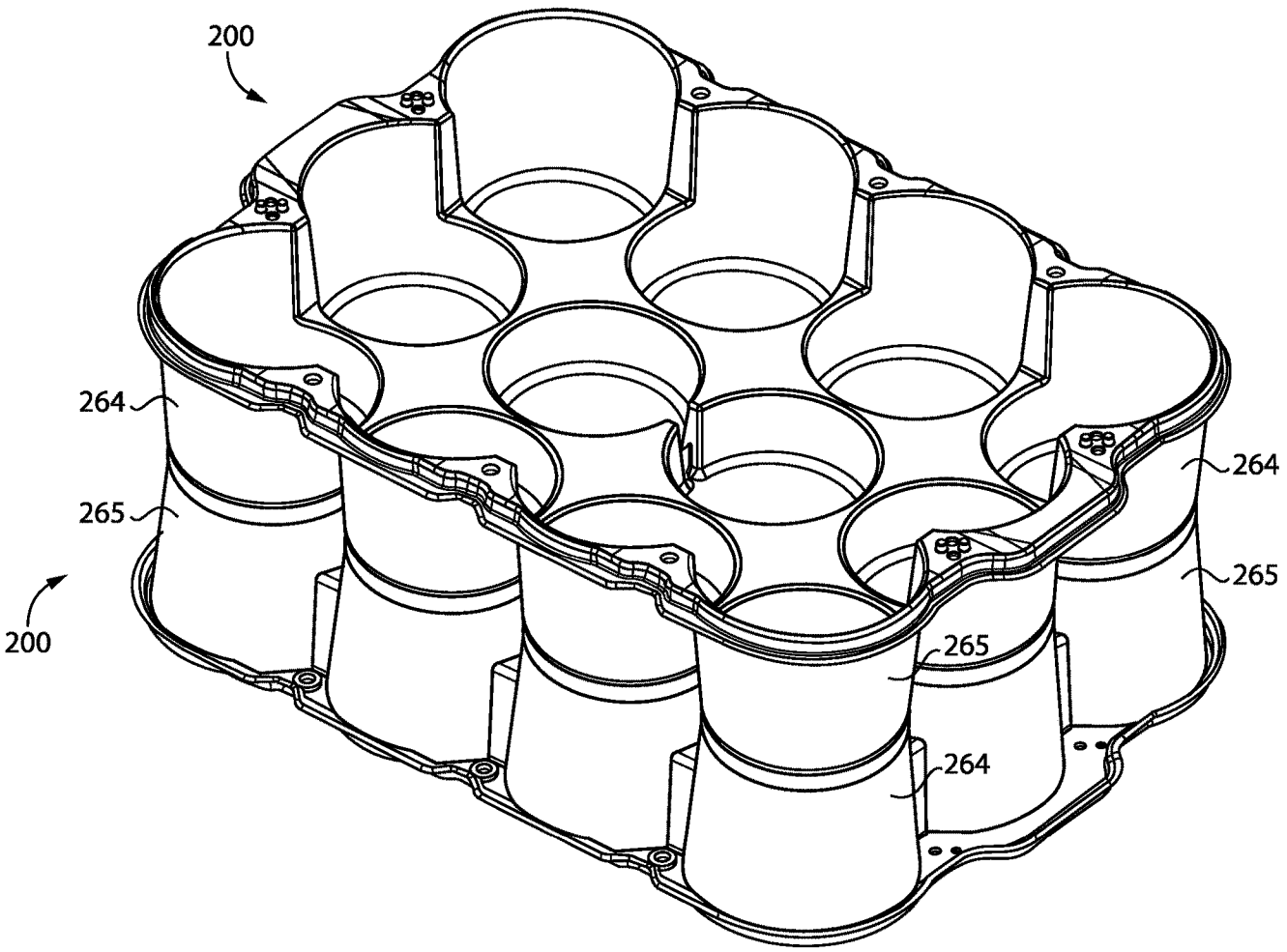
FIG. 7 is a perspective view of the first crate in a stacked configuration.

With additional reference to FIG. 7, illustrated therein are two trays 200 in a stacked configuration. For each tray, the first corner wells 264 alternate with the second corner wells 265 such that when the second sides 204 of two trays 200 face one another, each first corner well 264 of one tray 200 faces a corresponding second corner well 265 of the other tray 200, and each second corner well 265 of the one tray 200 faces a first corner well 264 of the other tray 200. As a result, each first engagement feature 240 of one tray 200 is operable to engage a second engagement feature 250 of the other tray 200, and each second engagement feature 250 of the one tray 200 is operable to engage a first engagement feature 240 of the other tray 200. With the engagement features 240, 250 engaged with one another, lateral shifting of the trays 200 relative to one another is inhibited, thereby facilitating the secure stacking of crates 100.

Figure 8:
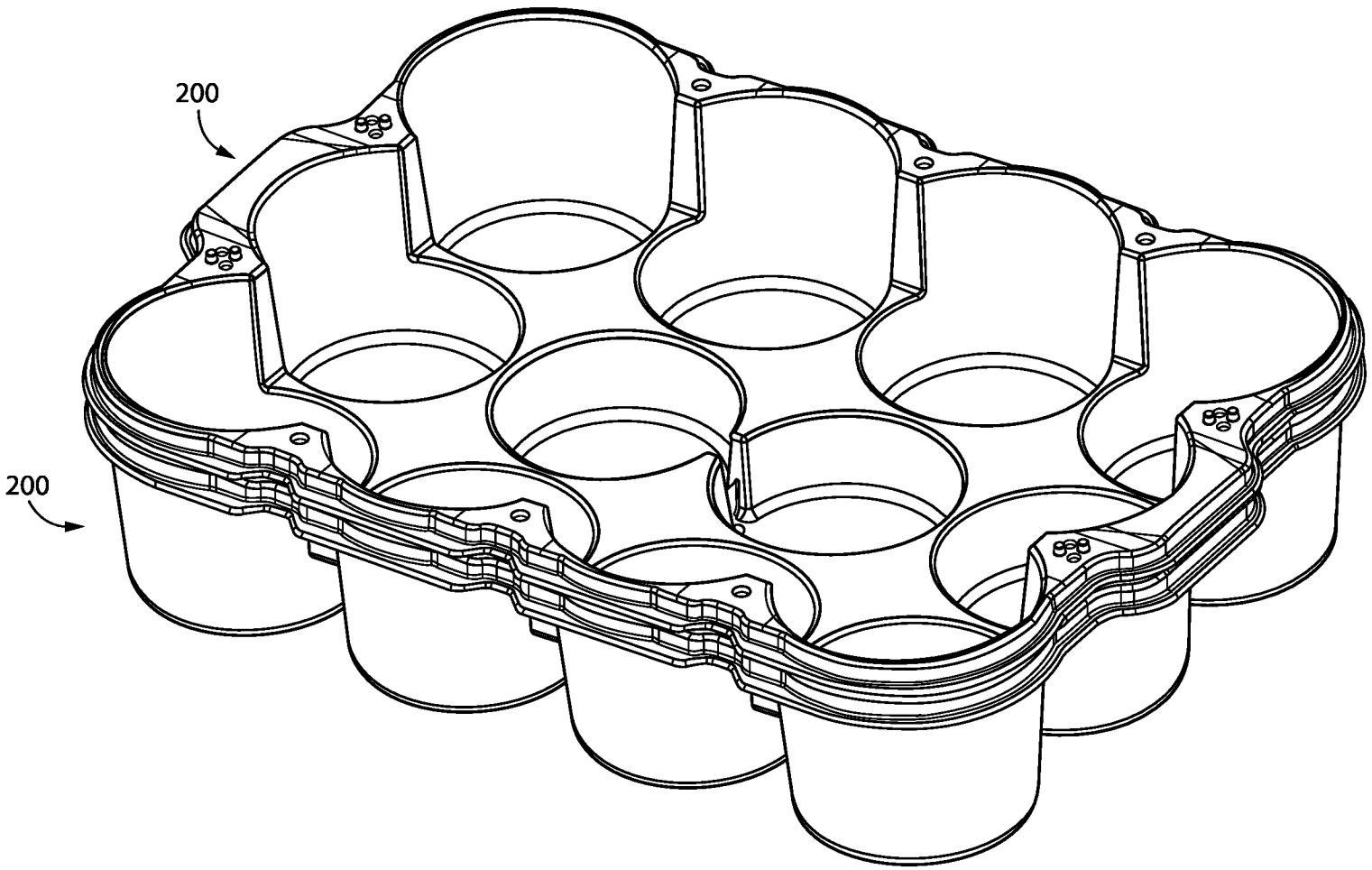
FIG. 8 is a perspective view of the first crate in a nested configuration.

With additional reference to FIG. 8, the tray 200 is also configured to nest with itself to facilitate storage in a more compact arrangement. In the nested configuration, the second or exterior side 204 of one tray 200 faces the interior or first side 202 of the other tray 200, and one tray 200 is received in the cavity 203 of the other tray 200. In order to facilitate such nesting, the wells 220 may be provided with a tapered configuration.

Figure 9:
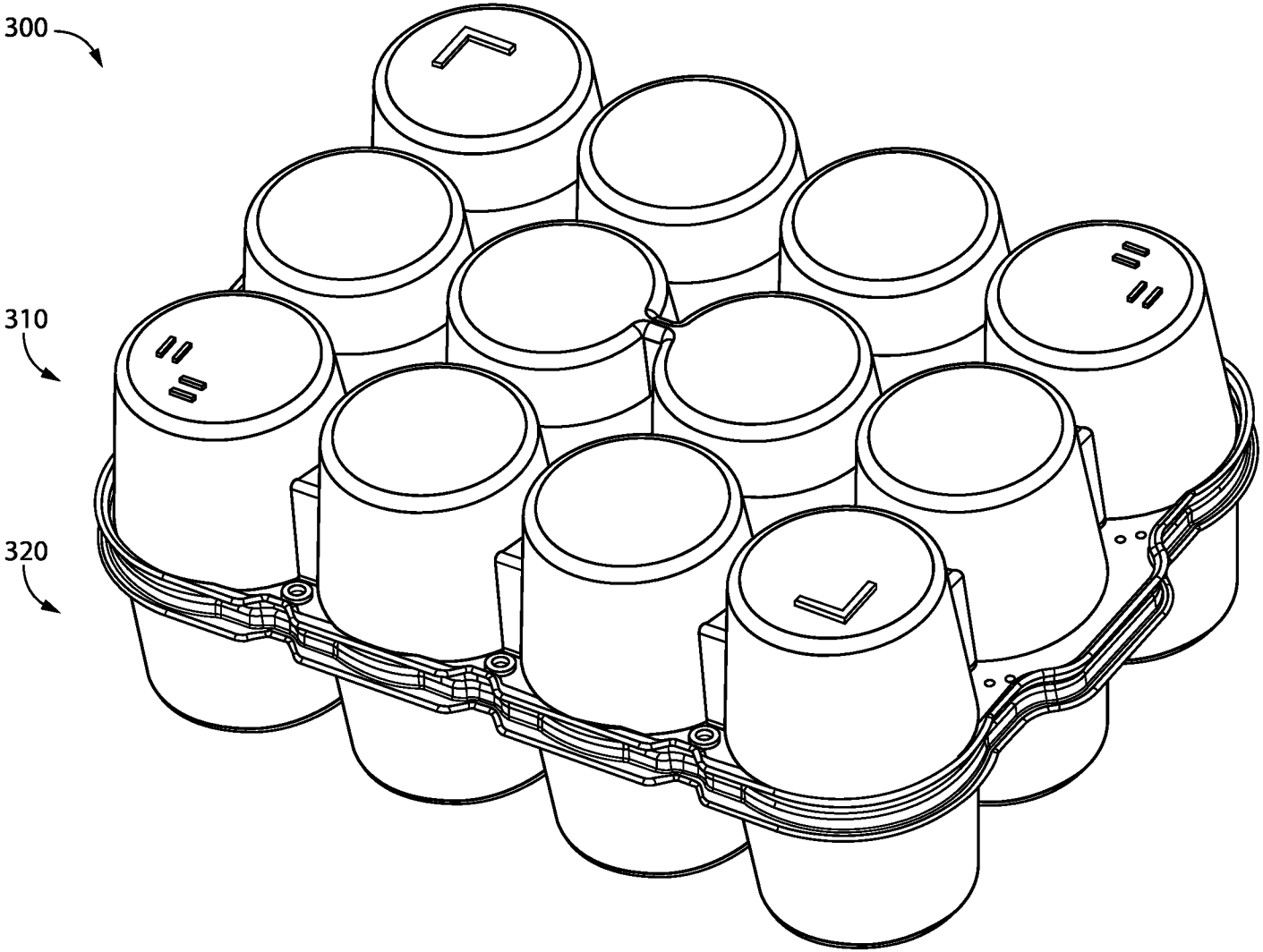
FIG. 9 is a perspective view of an assembled second crate according to certain embodiments.

With additional reference to FIG. 9, illustrated therein is a crate 300 according to certain embodiments. The crate 300 is substantially similar to the crate 100, and includes an upper tray 310 corresponding to the upper tray 110 and a lower tray 320 corresponding to the lower tray 120. In the illustrated form, the crate 300 is configured to hold standard pint-sized canning jars.

Figure 10:
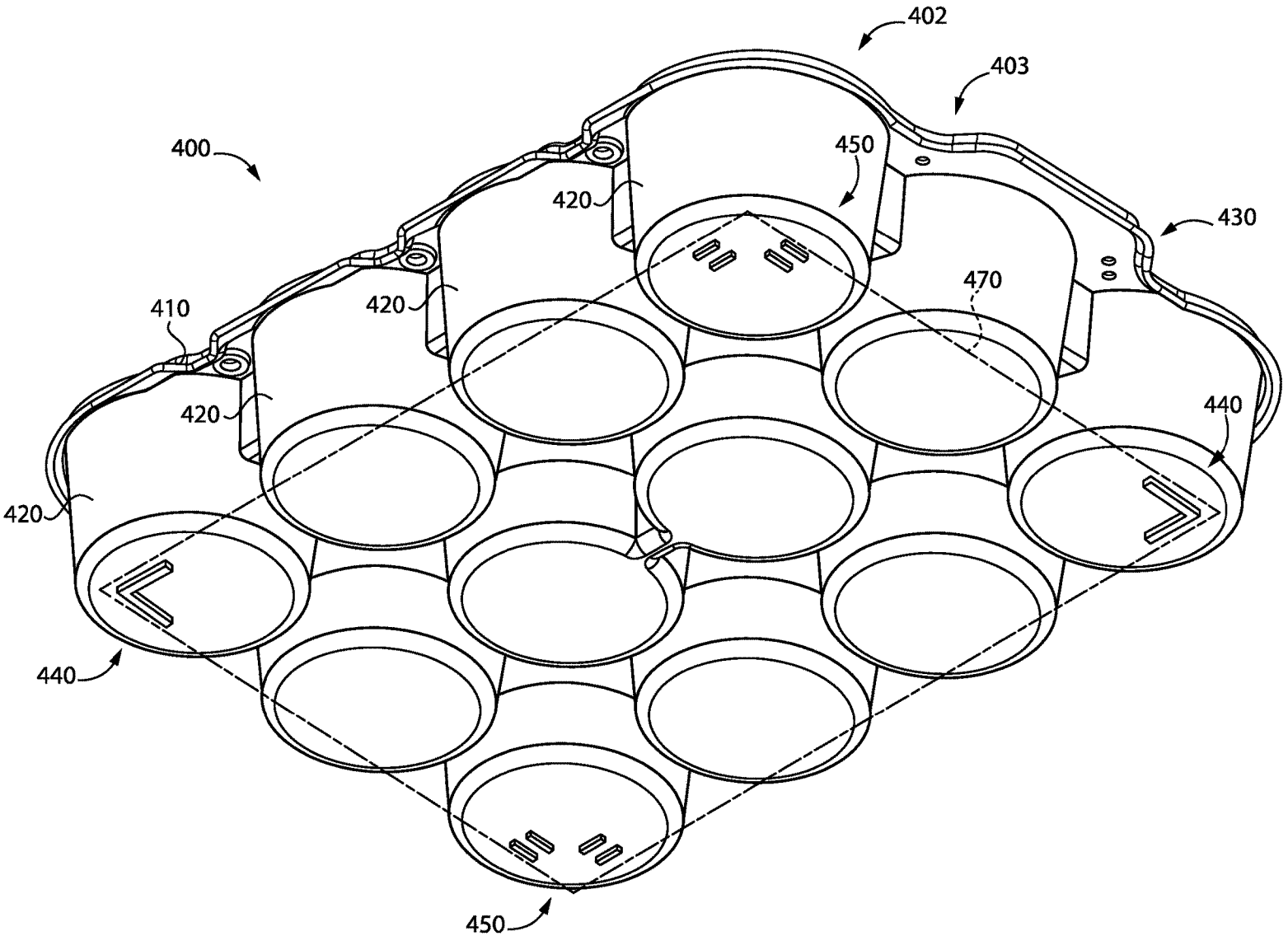
FIG. 10 is a perspective view of a second tray that may be utilized to build the second crate.

With additional reference to FIG. 10, illustrated therein is a tray 400 according to certain embodiments. The tray 400 may, for example, be utilized as the upper tray 310 and/or the lower tray 320 of the crate 300. For example, a first of the tray 400 may be utilized as the upper tray 310 and a second of the tray 400 may be utilized as the lower tray 320. The tray 400 is substantially similar to the above-described tray 200, and similar reference characters are used to indicate similar elements and features. For example, the tray 400 includes a base portion 410, a plurality of wells 420, one or more snap mechanisms 430, at least one first engagement feature 440, and at least one second engagement feature 450, which respectively correspond to the base portion 210, the wells 220, the snap mechanisms 230, the first engagement features 240, and the second engagement features 250. In the interest of conciseness, the following description of the tray 400 focuses primarily on elements and features of the second tray 400 that are different from those described above with reference to the first tray 200. It should be appreciated, however, that elements and features described with reference to one crate 100, 300 or one tray 200, 400 may be equally applicable to the other crate 100, 300 and/or the other tray 200, 400.

In the illustrated form, each well 420 is configured to hold a corresponding jar that is of a standard pint size. Thus, each well 420 is of a smaller size and a lesser diameter in comparison to the corresponding well 220 of the first tray 200. The four corner wells 460 include a pair of first corner wells 464 and a pair of second corner wells 465. Each of the first corner wells 464 includes a corresponding second tray first engagement feature 440, and each of the second corner wells 465 includes a corresponding second tray second engagement feature 450.

Like the engagement features 240, 250 of the first tray 200, the engagement features 440, 450 of the second tray 400 occupy and define an engagement area 470 corresponding to the engagement area 270. As with the above-described engagement features 240, 250, the engagement features 440, 450 are configured to mate with one another such that the tray 400 is stackable on itself in a manner analogous to that illustrated in FIG. 7. Thus, the crate 300 can be stacked on itself in a secure manner. The engagement features 440, 450 of the second tray 400 are also configured to mate with the engagement features 240, 250 of the first tray 200. More particularly, the first tray first engagement features 240 and the second tray second engagement features 450 are configured to mate with one another, and the first tray second engagement features 250 and the second tray first engagement features 440 are configured to mate with one another. Additionally, the first tray engagement area 270 is the same as the second tray engagement area 470, which facilitates stacking of the first crate 100 with the second crate 300 as described herein.

Figure 11:
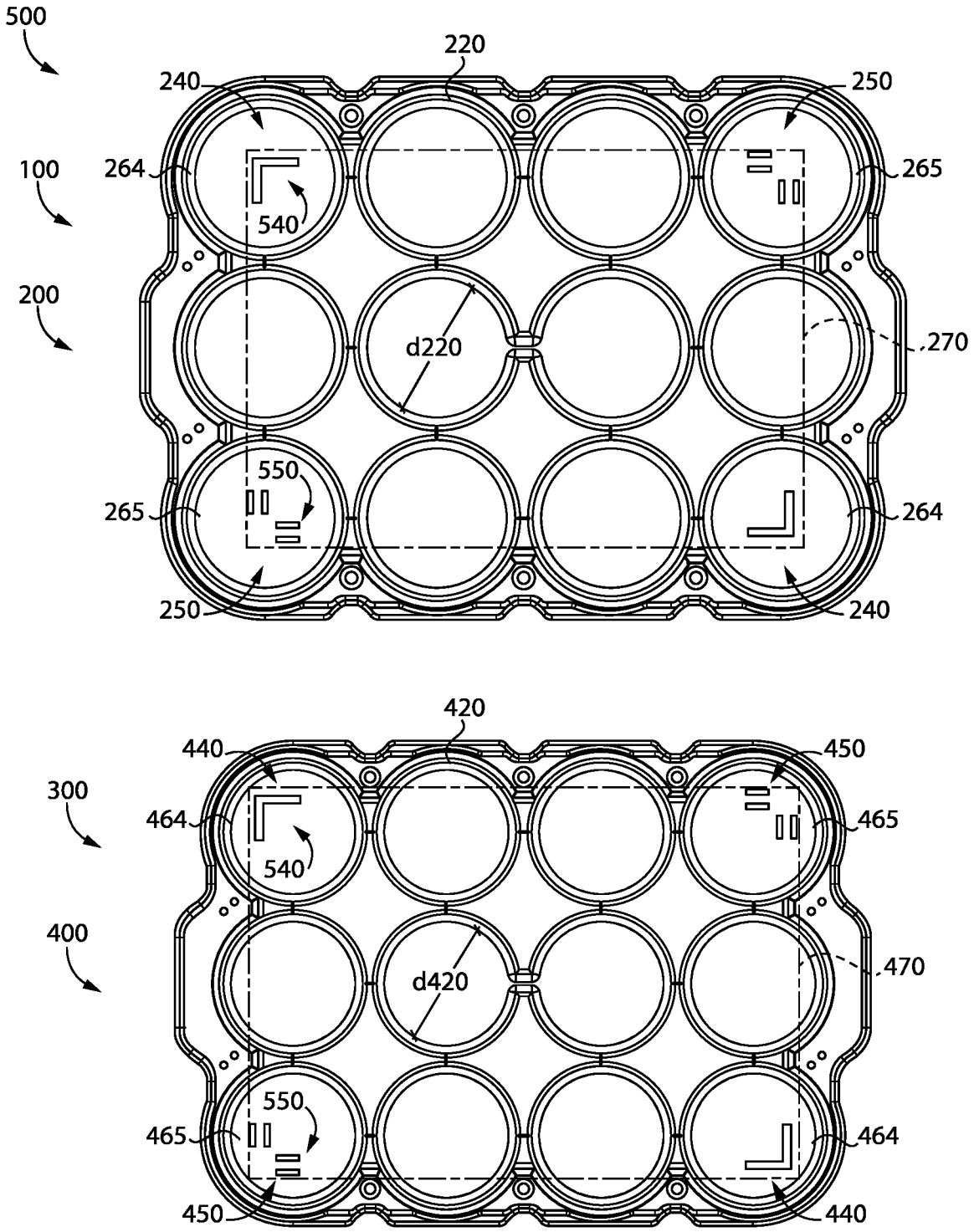
FIG. 11 is a plan view of a system according to certain embodiments.

With additional reference to FIG. 11, illustrated therein is a system 500 according to certain embodiments. The system 500 includes the first crate 100, which includes at least one first tray 200, and the second crate 300, which includes at least one second tray 400. For example, the system 500 may include a pair of first trays 200 that engage one another to define the first crate 100 and a pair of second trays 400 that engage one another to define the second crate 300.

As noted above, the first tray wells 220 are configured to receive quart-sized jars, and the second tray wells 420 are configured to receive pint-sized jars. Thus, the first tray wells 220 may have a first diameter d220, and the second tray wells 420 may have a second diameter d420 less than the first diameter d220. Each diameter d220, d420 may be measured at the base of the corresponding well 220, 420. Due to the larger diameters of the first tray wells 220 as compared to the second tray wells 420, it may be the case that the first tray 200 is larger than the second tray 400. For example, in the illustrated form, a plan-view area of the first tray 200 is larger than the plan-view area of the second tray 400. As used herein, the term "plan-view area" may be used to refer to the area of a component (e.g., a tray) when viewed from directly above the component.

It should be appreciated that although the first tray 200 is larger than the second tray 400, the trays 200, 400 can nonetheless be stacked with one another in a secure manner. This capability is provided at least in part by the ability of the first tray engagement features 240, 250 to mate with the second tray engagement features 440, 450, and in part by the arrangement of the engagement features in engagement areas 270, 470 that correspond to one another. The system 500 may thus facilitate stacking of various sizes of crates (and various sizes of jars) in stacks that include crates and jars of different sizes.

In the illustrated embodiments, the first tray 200 is configured to hold standard quart-sized canning jars, and the second tray 400 is configured to hold standard pint-sized canning jars. As such, the minimum diameter d220 of the first wells 220 is selected to correspond to the diameter of a standard quart-sized canning jar, and the minimum diameter d420 of the second wells 420 is selected to correspond to the diameter of a standard pint-sized canning jar. It is also contemplated that other sizes and diameters may be utilized. For example, the first diameter d220 may be selected to correspond to one of a 64-ounce canning jar, a 32-ounce canning jar, a 28-ounce canning jar, a 16-ounce canning jar, a 12-ounce canning jar, an 8-ounce canning jar, or a 4-ounce canning jar, and the second diameter d420 may be selected to correspond to another of a 64-ounce canning jar, a 32-ounce canning jar, a 28-ounce canning jar, a 16-ounce canning jar, a 12-ounce canning jar, an 8-ounce canning jar, or a 4-ounce canning jar.

Moreover, while certain embodiments have been described with specific reference to holding storage goods in the form of canning jars, it is also contemplated that trays according to other embodiments may be configured to hold other forms of storage goods. By way of non-limiting example, such trays may be configured to hold honey jars (e.g. 24-ounce honey jars, 16-ounce honey jars, or 12-ounce honey jars), honey bear bottles (e.g., 20-ounce honey bear bottles, or 12-ounce honey bear bottles), eggs (e.g., chicken eggs, duck eggs, or quail eggs), kombucha bottles, maple sugar jugs, or growlers. In certain embodiments, one or more trays or crates may be configured for use as seed planters, milking buckets, seed savers/holders, root cellar crates, or storage of bulk dry goods (e.g., flour, wheat, or sugar).

It should also be appreciated that the foregoing examples may be mixed and matched as desired. For example, the wells 220 of the first tray 200 may be configured to hold canning jars of a particular size, and the wells 420 of the second tray may be configured to hold honey bear bottles of a particular size.

Figure 12:
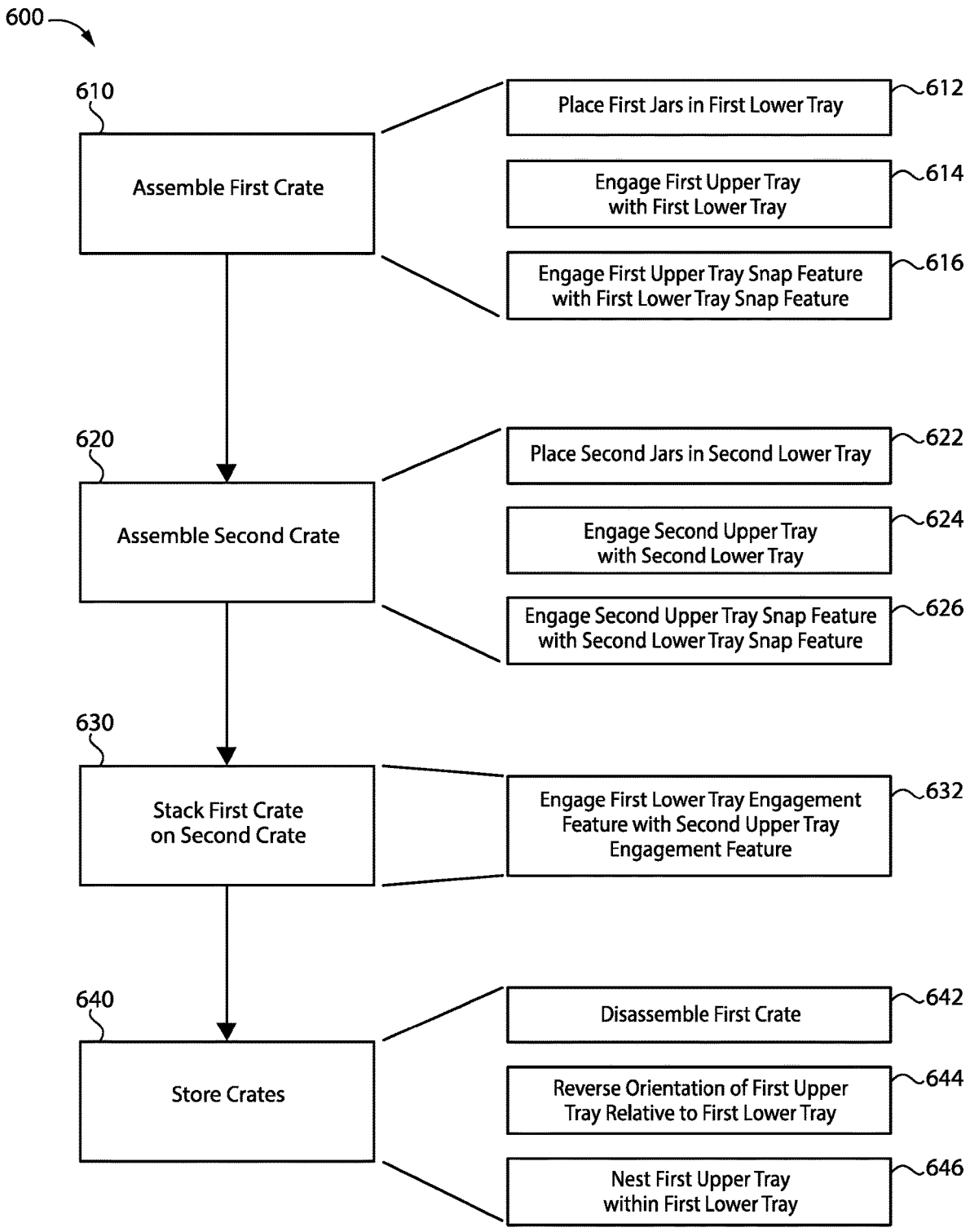
FIG. 12 is a schematic block diagram of a process according to certain embodiments.

With additional reference to FIG. 12, illustrated therein is a process 600 according to certain embodiments. Blocks illustrated for the processes in the present application are understood to be examples only, and blocks may be combined or divided, and added or removed, as well as reordered in whole or in part, unless explicitly stated to the contrary. While the blocks are illustrated in a relatively serial fashion, it is to be understood that two or more of the blocks may be performed concurrently or in parallel with one another. Moreover, while the process 600 is described herein with specific reference to the system 500 illustrated in FIG. 11, it is to be appreciated that the process 600 may be performed with crate stacking systems having additional or alternative features.

The process 600 generally includes a first crate assembly procedure 610, a second crate assembly procedure 620, a stacking procedure 630, and a storage procedure 640. As described herein, the first crate assembly procedure 610 generally involves assembling a first crate 100, and the second crate assembly procedure 620 generally involves assembling a second crate 300. The stacking procedure 630 generally involves stacking the first crate 100 on the second crate 300, and the storage procedure 640 generally involves disassembling one or both of the crates.

The first crate assembly procedure 610 may begin with two trays 200 operable to form a first crate 100. Of the two trays, one tray 200 may be designated as the first upper tray 110, and the other may be designated as the first lower tray 120. Each of the first upper tray 110 and the first lower tray 120 comprises a corresponding plurality of first wells 220. At least one first well 220 of the first bottom tray 120 (e.g., the corner well 264) comprises a corresponding first engagement feature (e.g., the engagement feature 240) on a bottom surface 224 thereof.

The procedure 610 may begin with block 612, which generally involves placing one or more storage goods in the first lower tray 120. For example, block 612 may involve placing one or more quart-sized jars in one or more corresponding wells 220 of the first lower tray 120. In the illustrated form, block 612 may involve positioning up to twelve quart-sized jars in the twelve wells 220. It is also contemplated that more or fewer wells 220 may be provided to the tray 200 to accommodate more or fewer jars.

The procedure 610 may include block 614, which generally involves engaging the first upper tray 110 with the first lower tray 120. For example, block 614 may involve positioning the trays 110, 120 in opposite orientations such that the female first sides 202 face one another, and placing the base portions 210 in contact with one another to thereby enclose the one or more jars within the enclosed cavity 203.

The procedure 610 may include block 616, which generally involves engaging a snap mechanism 230 of the first upper tray 110 with a corresponding snap mechanism 230 of the first lower tray 120. For example, block 616 may involve engaging the snap mechanisms 230 such that each protrusion 233 of one tray 200 is received in a corresponding recess 235 of the other tray 200.

The second crate assembly procedure 620 may begin with two trays 400 operable to form a second crate 300. Of the two trays, one tray 400 may be designated as the second upper tray 310, and the other may be designated as the second lower tray 320. Each of the second upper tray 310 and the second lower tray 320 comprises a corresponding plurality of second wells 420. At least one second well 420 of the second upper tray 320 (e.g., the corner well 465) comprises a corresponding second engagement feature (e.g., the engagement feature 450) on an upper surface 424 thereof. Each of the second wells 420 has a different size than a corresponding one of the first wells 220. In the illustrated form, each of the second wells 420 is configured to receive a pint-sized jar, and is accordingly smaller than the corresponding one of the first wells 220 for receiving quart-sized jars.

The procedure 620 may begin with block 622, which generally involves placing one or more storage goods in the second lower tray 320. For example, block 622 may involve placing one or more pint-sized jars in one or more corresponding wells 420 of the second lower tray 320. In the illustrated form, block 622 may involve positioning up to twelve pint-sized jars in the twelve wells 420. It is also contemplated that more or fewer wells may be provided to the tray 400 to accommodate more or fewer jars.

The procedure 620 may include block 624, which generally involves engaging the second upper tray 310 with the second lower tray 320. For example, block 624 may involve positioning the trays 310, 320 in opposite orientations such that the female first sides 402 face one another, and placing the base portions 410 in contact with one another to thereby enclose the one or more jars within the enclosed cavity 403.

The procedure 620 may include block 626, which generally involves engaging a snap mechanism 430 of the second upper tray 310 with a corresponding snap mechanism 430 of the second lower tray 320. For example, block 626 may involve engaging the snap mechanisms 430 such that each protrusion of one tray 400 is received in a corresponding recess of the other tray 400 in a manner analogous to that described above with reference to engagement of the snap mechanisms 230.

The stacking procedure 630 generally involves stacking the first crate 100 on the second crate 300. More particularly, the procedure 630 includes block 632, which generally involves engaging the engagement feature 240 of the first lower tray 120 with the engagement feature 450 of the second upper tray 310 to thereby discourage relative shifting of the first crate 100 and the second crate 300.

Those skilled in the art will readily appreciate that the first crate assembly procedure 610 and/or the second crate assembly procedure 620 may be repeated as desired to form additional crates 100, 300 of selected sizes. Moreover, such additional crates 100, 300 may be stacked atop one another as desired, for example according to the stacking procedure 630. Due to the congruence of the engagement areas 270, 470, the crates 100, 300 may be stacked in any desired order.

In certain embodiments, the process 600 may involve a storage procedure 640, which generally involves disassembling and storing one or more crates. For example, the procedure 640 may include block 642, which generally involves disassembling the first crate 110. Block 642 may, for example, involve disengaging the snap mechanisms 230 and removing the first upper tray 110 from the first lower tray 120 such that the jars may be removed. The procedure 640 may include block 644, which generally involves reversing the orientation of one of the first trays 200 such that the female first side 202 of one tray 200 faces the male second side 204 of the other tray 200. The procedure 640 may then continue to block 646, which involves nesting the trays 200 within one another, for example as illustrated in FIG. 8. As a result of the nesting, each well 220 of one tray 200 may be received in a corresponding well 220 of the other tray 200. Those skilled in the art will readily appreciate that the second crate 300 and/or any additional crates may be disassembled and stored in a manner analogous to that described with reference to the first crate 100.

Certain embodiments of the present application relate to a system 500 for holding storage goods of varying sizes, the system 500 comprising: a first tray 200 comprising a first plurality of wells 220, the first plurality of wells 220 including a first tray first well 264, wherein the first tray first well 264 comprises a first engagement feature 240 on an exterior surface thereof, and wherein the first engagement feature 240 has a first geometry 240'; and a second tray 400 comprising a second plurality of wells 420, the second plurality of wells 420 including a second tray first well 465, wherein the second tray first well 465 comprises a second engagement feature 450 on an exterior surface thereof, wherein the second engagement feature 450 has a second geometry 450' configured to mate with the first geometry 240' such that the second engagement feature 450 is operable to engage the first engagement feature 240 to thereby discourage relative shifting of the first tray 200 and the second tray 400; wherein each well of the first plurality of wells 220 has a greater diameter than each well of the second plurality of wells 420.

In certain embodiments, the first plurality of wells 220 further comprises a first tray second well 265, the first tray second well 265 comprising a third engagement feature 250 on an exterior surface thereof; wherein the second plurality of wells 420 further comprises a second tray second well 464, the second tray second well 464 comprising a fourth engagement feature 440 on an exterior surface thereof, and wherein the fourth engagement feature 440 is operable to engage the third engagement feature 250 to thereby further discourage relative shifting of the first tray 200 and the second tray 400.

Certain embodiments of the present application relate to a system 500 for holding storage goods of varying sizes, the system 500 comprising: a first tray 200 comprising a first plurality of wells 220, the first plurality of wells 220 including a pair of first tray first wells 264 and a pair of first tray second wells 265, wherein each first tray first well 264 comprises a corresponding first engagement feature 240 on an exterior surface thereof, wherein each first tray second well 265 comprises a corresponding second engagement feature 265 on an exterior surface thereof; and a second tray 400 comprising a second plurality of wells 420, the second plurality of wells 420 including a pair of second tray first wells 465 and a pair of second tray second wells 464, wherein each second tray first well 465 comprises a corresponding third engagement feature 450 on an exterior surface thereof, wherein each second tray second well 464 comprises a corresponding fourth engagement feature 440 on an exterior surface thereof. Each well of the first plurality of wells 220 has a greater diameter than each well of the second plurality of wells 420. Each first engagement feature has a first geometry 540, each second engagement feature has a second geometry 550, each third engagement feature 450 has the second geometry 550, and each fourth engagement feature 440 has the first geometry 540. The first geometry 540 is sized and shaped to mate with the second geometry 550.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected.

It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A system for holding storage goods of varying sizes, the system comprising:

a first tray comprising a first plurality of wells and a first instance of an engagement area, wherein the first instance of the engagement area is distributed among two or more first wells of the first plurality of wells; and a second tray comprising a second plurality of wells and a second instance of the engagement area, wherein the second instance of the engagement area is distributed among two or more second wells of the second plurality of wells, and wherein the second instance of the engagement area is configured to mate with the first instance of the engagement area to thereby discourage relative shifting of the first tray and the second tray;

wherein each well of the first plurality of wells has a greater diameter than each well of the second plurality of wells; and wherein the first instance of the engagement area and the second instance of the engagement area share a common configuration.

2. The system of claim 1, wherein each well of the first plurality of wells is configured to hold a canning jar of a first size; and wherein each well of the second plurality of wells is configured to hold a canning jar of a second size smaller than the first size.

3. The system of claim 1, wherein the common configuration of the engagement area comprises a protrusion and a recess sized and shaped to matingly receive the protrusion.

4. The system of claim 3, wherein the recess is formed between two or more ridges.

5. The system of claim 3, wherein each of the protrusion and the recess is L-shaped.

6. The system of claim 1, wherein the first tray has a first plan-view area; and wherein the second tray has a second plan-view area less than the first plan-view area.

7. A system for holding storage goods of varying sizes, the system comprising:

a first tray comprising a first plurality of wells and a first instance of an engagement area, wherein each well of the first plurality of wells has a first diameter, and wherein the first instance of the engagement area is formed on exterior surfaces of the first plurality of wells;

a second tray comprising a second plurality of wells and a second instance of an engagement area, wherein each well of the second plurality of wells has a second diameter different from the first diameter, and wherein the second instance of the engagement area is formed on exterior surfaces of the second plurality of wells;

wherein the engagement area comprises recesses and protrusions, and wherein the recesses and protrusions are configured such that the first instance of the engagement area is operable to engage the second instance of the engagement area to thereby discourage relative shifting of the first tray and the second tray; and wherein the first instance of the engagement area and the second instance of the engagement area share a common configuration.

8. The system of claim 7, wherein a plan-view area of the first tray is different from a plan-view area of the second tray.

9. The system of claim 7, wherein each recess is defined at least in part by a ridge.

10. The system of claim 7, wherein the exterior surfaces of the first wells define floors of the recesses of the first instance of the engagement area; and wherein the exterior surfaces of the second wells define floors of the recesses of the second instance of the engagement area.

11. The system of claim 7, wherein each instance of the engagement area projects from a flat area of the corresponding exterior surface such that the flat areas define bottoms of the corresponding recesses.

12. The system of claim 7, wherein the exterior surfaces of the wells are flat but for the engagement area, and wherein each engagement area projects from the corresponding exterior surfaces such that the flat exterior surfaces define bottoms of the recesses.

13. A system for holding storage goods of varying sizes, the system comprising:

a plurality of trays comprising a first tray and a second tray, wherein each tray of the plurality of trays comprises:

a corresponding plurality of wells, wherein the wells of the first tray have a first diameter, wherein the wells of the second tray have a second diameter different from the first diameter; and a corresponding instance of an engagement area formed on bottom surfaces of the corresponding plurality of wells, wherein each instance of the engagement area is identical and configured to mate with each other instance of the engagement area to thereby discourage shifting of the corresponding trays.

14. The system of claim 13, wherein the bottom surfaces are flat but for one or more projections of the engagement area.

15. The system of claim 13, wherein each instance of the engagement area comprises one or more instances of a first engagement feature and one or more instances of a second engagement feature; and wherein each instance of the first engagement feature is sized and shaped to mate with each instance of the second engagement feature.

16. The system of claim 15, wherein each instance of the first engagement feature consists of at least one first protrusion;

wherein each instance of the second engagement feature consists of at least one second protrusion that defines at least one recess sized and shaped to receive each at least one first protrusion.

17. The system of claim 15, wherein each instance of the first engagement area comprises an L-shaped protrusion including a first leg and a second leg; and wherein each instance of the second engagement area comprises a first channel sized and shaped to receive the first leg and a second channel sized and shaped to receive the second leg.

18. The system of claim 13, further comprising a first crate and a second crate;

wherein the first crate comprises the first tray and an additional first tray identical to the first tray; and wherein the second crate comprises the second tray and an additional second tray identical to the second tray.

* * * * *